US011407025B2

(12) United States Patent
Sasaki et al.

(10) Patent No.: US 11,407,025 B2
(45) Date of Patent: Aug. 9, 2022

(54) CASTING APPARATUS

(71) Applicant: MAZDA MOTOR CORPORATION, Hiroshima (JP)

(72) Inventors: Daichi Sasaki, Hiroshima (JP); Masatoshi Juri, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 17/481,593

(22) Filed: Sep. 22, 2021

(65) Prior Publication Data

US 2022/0105558 A1 Apr. 7, 2022

(30) Foreign Application Priority Data

Oct. 5, 2020 (JP) ..... JP2020-168455

(51) Int. Cl.

| | |
|---|---|
| ***B22C 9/24*** | (2006.01) |
| ***B22C 9/08*** | (2006.01) |
| ***B22C 9/10*** | (2006.01) |
| ***B22D 17/22*** | (2006.01) |

(52) U.S. Cl.

CPC ..... *B22C 9/24* (2013.01); *B22C 9/08* (2013.01); *B22D 17/22* (2013.01); *F02F 2200/06* (2013.01)

(58) Field of Classification Search

CPC .... B22C 9/08; B22C 9/10; B22C 9/24; B22D 17/22; F02F 2200/06

USPC ..... 164/339, 340, 341, 342, 367

See application file for complete search history.

(56) References Cited

U.S. PATENT DOCUMENTS 3,433,292 A * 3/1969 McDonald ..... B22D 17/24 425/593

2007/0204969 A1* 9/2007 Whealy et al. .... B22D 19/0009 164/137

FOREIGN PATENT DOCUMENTS

JP 2013-240818 A 12/2013

* cited by examiner

*Primary Examiner* — Kevin P Kerns

(74) *Attorney, Agent, or Firm* — Studebaker & Brackett PC

(57) ABSTRACT

A casting apparatus for a cylinder block prevents deformation of a core pin and a cast passage formed by the core pin due to impact of molten metal when casting. Embodiments include a first side mold having a first core pin, a second side mold having a second core pin, a third mold having a molten metal inlet, and a metal dowel. The molten metal inlet is disposed so the inflow direction of molten metal intersects the axial direction of the first and second core pins, which are butted against each other at mold clamping and constitute a core for forming a main gallery for lubricant. The metal dowel is disposed between the molten metal inlet and a butt portion between the first and second core pins so that the butt portion is covered by the metal dowel from the upstream side in the inflow direction of the molten metal.

13 Claims, 12 Drawing Sheets

CASTING APPARATUS

TECHNICAL FIELD

The present disclosure relates to a casting apparatus.

BACKGROUND ART

A known structure of the cylinder block of an engine has a main gallery as an oil passage. The main gallery is a long passage, extending in the cylinder arrangement direction, that supplies a lubricant to an oil jet directed to the crankshaft and the back surface of the piston inside the engine. In the case of a cylinder block that is long in the cylinder arrangement direction, such as the cylinder block of an in-line multi-cylinder (for example, six or more cylinder) engine, a main gallery is formed by machining with a drill or the like after the cylinder block is cast. However, in this case, a manufacturing cost for machining is incurred in addition to the casting.

Consequently, the main gallery is sometimes formed using a core pin at the time of casting to reduce costs. The main gallery is formed by a pair of core pins butted against each other at the time of casting. However, molten metal may directly hit the core pin and deform the core pin when the molten metal is injected. Accordingly, a direct hit on the core pin by the molten metal is avoided by disposing the core pin at a position away from the molten metal inlet through which the molten metal is injected into the cavity inside the mold; specifically, at a position opposite to the molten metal inlet across each cylinder liner.

In recent years, a technique has been proposed for changing the number of main galleries used depending on the driving situation for the purpose of improving the fuel efficiency and the emissions of an engine. In the case of the cylinder block with two or more main galleries as described above, another main gallery needs to be added near the molten metal inlet. As a result, the core pin that forms the main gallery near the molten metal inlet cannot avoid a direct hit by the molten metal and may be deformed.

To prevent the deformation of the core pin described above, Japanese patent document JP-A-2013-240818 discloses a mold in which inclined surfaces facing each other in the flow direction of the molten metal are formed in the butt portion between the first core pin and the second core pin, and these inclined surfaces make contact with each other to suppress the deformation of these core pins.

However, even in the structure in which the inclined surfaces are formed in the butt portion between the core pins as in the mold described above, various problems may occur when the lengths of the core pins are longer or the butt load between the core pins is increased. For example, disadvantageously, misalignment of axes may occur in the end portions of the core pins, the core pins may be deformed due to the thermal expansion of the core pins at the injection of the molten metal, or burrs may be generated due to the entry of the molten metal between the inclined surfaces. In this case, the cast passage needs to be post-processed by a drill or the like after casting. In particular, when the butt load is increased so as to withstand a direct hit by the molten metal, the core pins may be further deformed.

SUMMARY

The present disclosure addresses the situations described above to provide a casting apparatus that casts the cylinder block of an engine in which the deformation of the core pins due to an impact of the molten metal at casting is avoided when a cast passage as a main gallery is formed near a molten metal inlet using core pins, and as a result the deformation of the cast passage is avoided.

To solve the problem described above, there is provided a casting apparatus that casts a cylinder block of an engine, including a first side mold having a first core pin; a second side mold disposed facing the first side mold, the second side mold having a second core pin extending along an axial line that is the same as in the first core pin; a third mold that forms a cavity together with the first side mold and the second side mold at mold clamping, the third mold having a molten metal inlet through which molten metal is injected into the cavity; and a metal dowel at least a part of which is disposed in the cavity, in which the molten metal inlet is disposed so that an inflow direction of the molten metal from the molten metal inlet to the cavity intersects with an axial direction of the first core pin and the second core pin, the first core pin and the second core pin form a core for forming a main gallery that is a passage in the cylinder block through which a lubricant flows by butting end portions of the first core pin and the second core pin against each other at mold clamping, and the metal dowel is disposed at a position between the molten metal inlet and the butt portion between the first core pin and the second core pin at which the butt portion is covered and shielded by the metal dowel from an upstream side in the inflow direction of the molten metal.

In this structure, when the cylinder block having the main gallery in a side portion of the cylinder block near the molten metal inlet is cast, the first side mold, the second side mold, and the third mold are combined to form the cavity at mold clamping and the first core pin and the second core pin are butted against each other to form the main gallery in the cavity. In the cavity, the metal dowel is disposed at the position between the molten metal inlet and the butt portion between the first core pin and the second core pin at which the butt portion can be covered and shielded by the metal dowel from the upstream side in the inflow direction of the molten metal. Since the butt portion is covered and shielded by the metal dowel from the upstream side in the inflow direction of the molten metal in this state, a direct hit on the butt portion by the molten metal can be avoided when the molten metal flows into the cavity from the molten metal inlet. Accordingly, the butt portion, which is the bending start point of the first and second core pins, is protected from a direct hit on the molten metal, whereby the deformation of the first and second core pins can be prevented and the deformation of the main gallery, which is the cast passage formed by the first and second core pins, can also be prevented. Furthermore, the occurrence of burrs in the butt portion can be prevented by keeping these pins butted against each other. As a result, machining with a drill or the like is not necessary to form the main gallery.

In the casting apparatus described above, preferably, the metal dowel is disposed so as to intersect the axial direction of the first core pin and the second core pin.

In this structure, the metal dowel that forms the cast passage extends so as to intersect the axial direction of the first core pin and the second core pin and is disposed closer to the molten metal inlet than the first core pin and the second core pin, so that the butt portion between the first core pin and the second core pin is extensively covered by the metal dowel extending in the intersecting direction. This avoids a direct hit on the butt portion by the molten metal.

In the casting apparatus described above, preferably, the first core pin and the second core pin are disposed so as to extend in a horizontal direction, and the metal dowel is disposed so as to extend in a vertical direction.

In this structure, the metal dowel forms the cast passage extending in the vertical direction. The metal dowel orthogonally intersects the first core pin and the second core pin extending in the horizontal direction and is disposed closer to the molten metal inlet than the first core pin and the second core pin so as to extensively cover the butt portion between the first core pin and the second core pin with the metal dowel extending in the vertical direction. This can more reliably avoid a direct hit on the butt portion by the molten metal.

In the casting apparatus described above, preferably, the metal dowel is a core member that forms, in the cylinder block, an oil return passage through which the lubricant is returned from a cylinder head to a crankcase.

In such a structure, by using the core member that forms, in the cylinder block, the oil return passage through which the lubricant is returned from the cylinder head to the crankcase as the metal dowel described above, it is possible to avoid a direct hit on the butt portion between the first core pin and the second core pin by the molten metal by covering the butt portion. Accordingly, it is not necessary to provide a dedicated metal dowel for avoiding a direct hit on the butt portion by the molten metal separately from the core member for the oil return passage, thereby avoiding an increase in the number of components of the casting apparatus.

In the casting apparatus described above, preferably, the metal dowel is disposed so as to extend in the horizontal direction from an upstream side in the inflow direction of the molten metal so as to intersect the axial direction of the first core pin and the second core pin, and an end of the metal dowel is disposed at a position at which the butt portion is covered and shielded by the end from the upstream side in the inflow direction of the molten metal.

In this structure, the metal dowel extends in the horizontal direction from the upstream side in the inflow direction of the molten metal so as to intersect the axial direction of the first core pin and the second core pin, and the end of the metal dowel is disposed on the upstream side in the inflow direction of the molten metal of the butt portion. In this structure, the molten metal toward the butt portion flows in the horizontal direction along the metal dowel, thereby weakening the momentum of the molten metal toward the butt portion due to the flow resistance around the metal dowel. Furthermore, since the butt portion is covered and shielded by the end of the metal dowel from the upstream side in the inflow direction of the molten metal, a direct hit on the butt portion by the molten metal can be avoided.

In the casting apparatus described above, preferably, the metal dowel is a core member that forms a cast hole for thinning or attachment of an auxiliary that extends in the horizontal direction.

In this structure, it is possible to cover the butt portion between the first core pin and the second core pin and avoid a direct hit on the butt portion by the molten metal by using, as the metal dowel described above, the core member that forms the cast hole for thinning or attachment of an auxiliary that extends in the horizontal direction. Accordingly, a dedicated metal dowel for avoiding a direct hit on the butt portion by the molten metal does not need to be provided separately from the core member for the above purpose, thereby avoiding an increase in the number of components of the casting apparatus.

In the casting apparatus described above, preferably, a first spring and a second spring are disposed in series in a base end portion of at least one of the first core pin and the second core pin, the first spring and the second spring being elastically deformable in the axial direction of the first core pin and the second core pin, and the first spring is distorted by a predetermined amount in advance before the first core pin and the second core pin are butted against each other, and a load on the first spring differs from a load on the second spring when the first core pin and the second core pin are butted against each other.

In this structure, when the first core pin and the second core pin are butted against each other, only the second spring of the first spring and the second spring disposed in series is compressed and the first core pin and the second core pin can be butted against each other with a large spring constant, a short stroke, and an appropriate load. In contrast, when the cylinder block is formed by casting, the change in the load with respect to the stroke amount can be reduced with a low spring constant by simultaneously compressing the first spring and second spring about the elongation due to thermal expansion of the first and second core pins. As a result, the bending of the first and second core pins can be prevented.

The casting apparatus according to the present disclosure can prevent the deformation of the core pins due to an impact of the molten metal at casting when the cast passage is formed near the molten metal inlet using the core pins. As a result, the deformation of the cast passage formed by the core pins can be prevented.

DETAILED DESCRIPTION

A preferred embodiment of the present disclosure will be described in detail below with reference to the accompanying drawings.

Figure 1:
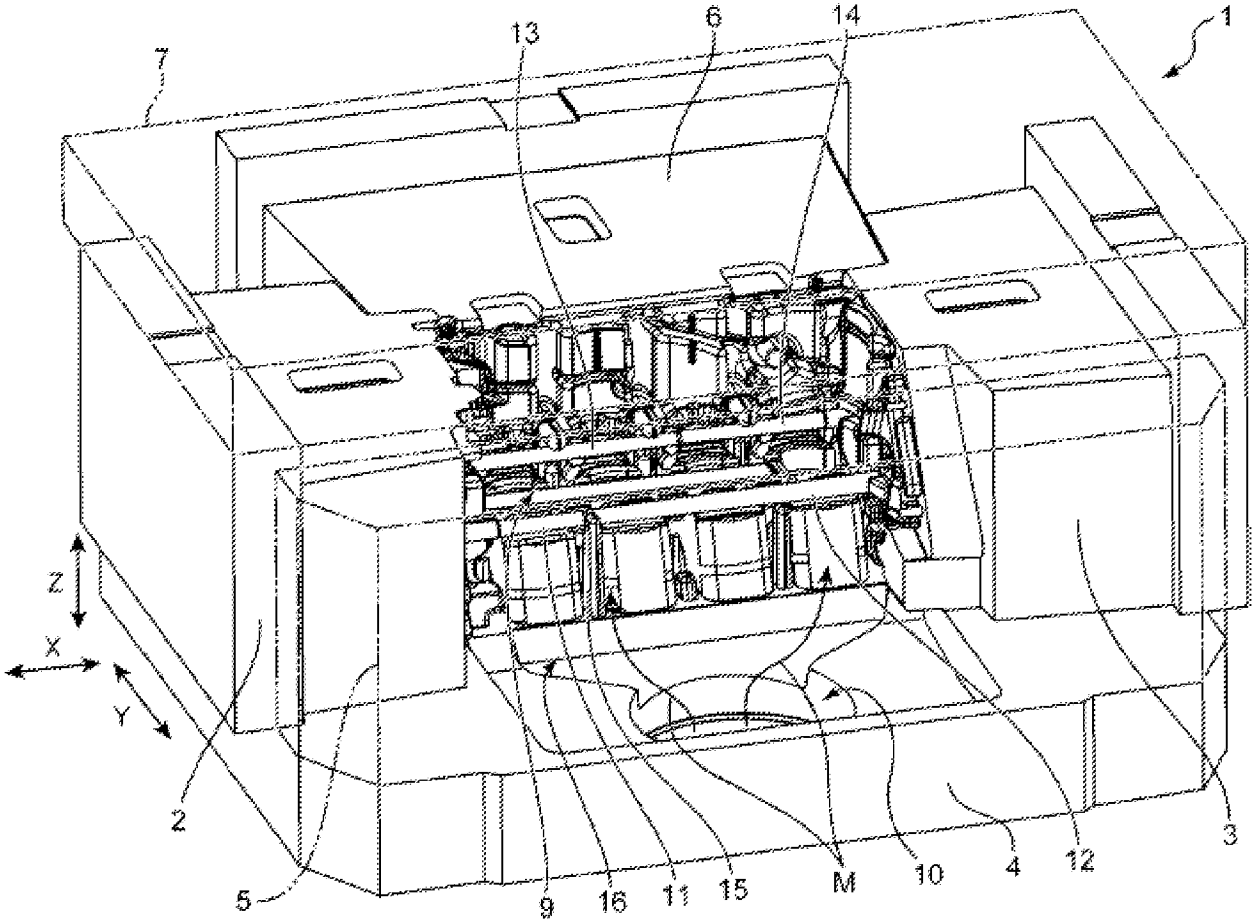
FIG. 1 is a perspective view illustrating the overall structure of a casting apparatus according to an embodiment of the present disclosure.
Figure 12:
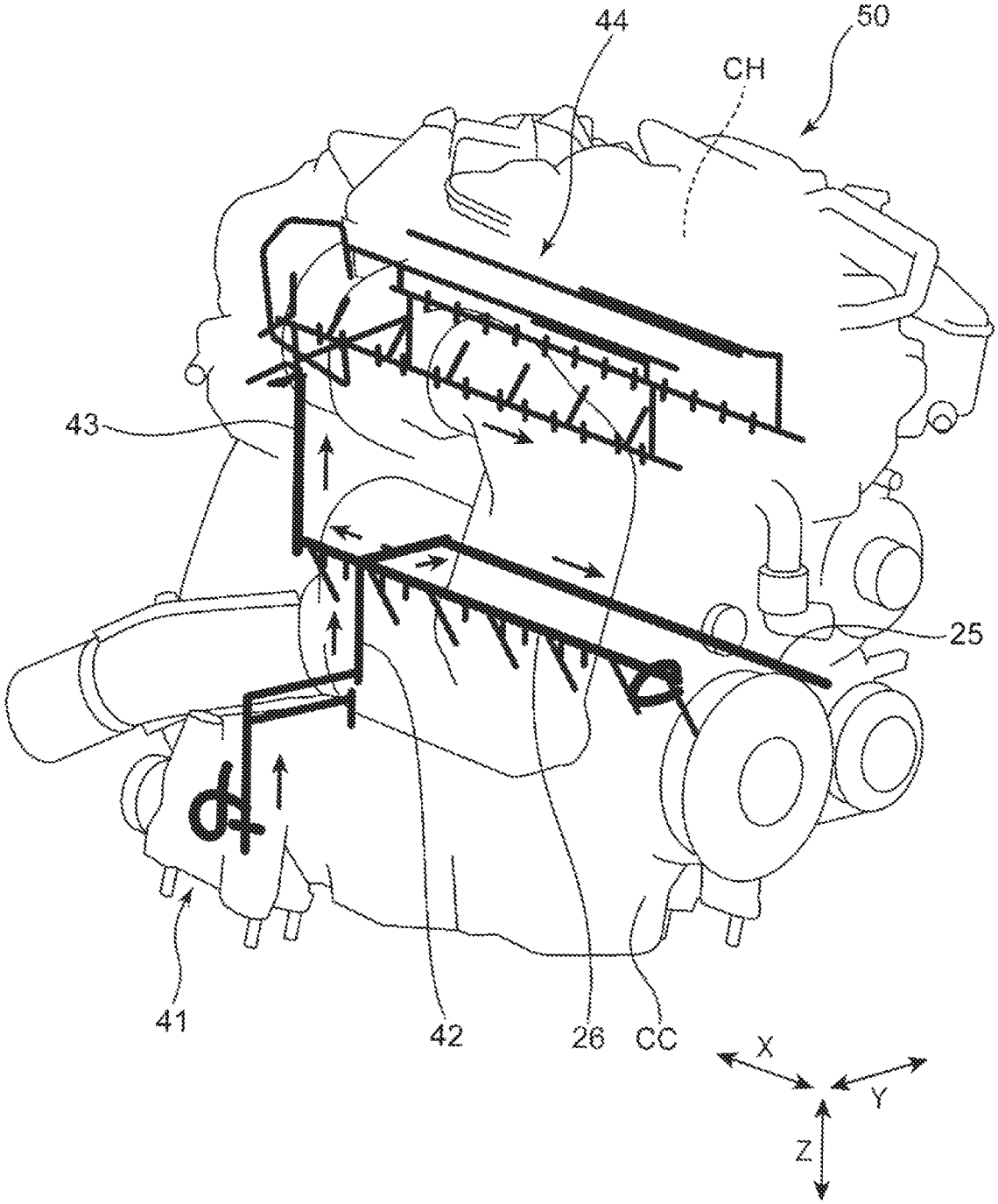
FIG. 12 is a perspective explanatory view illustrating the lubrication structure having two main galleries, which are passages for a lubricant in an engine.

A casting apparatus 1 illustrated in FIG. 1 is an apparatus for casting a cylinder block B (see FIG. 10) of an engine 50 (see FIG. 12). Although the shape of the cylinder block B cast by the casting apparatus 1 is not particularly limited in the present disclosure, a cylinder block of, for example, an in-line multi-cylinder (four-cylinder in this embodiment) engine is manufactured by the casting apparatus 1.

(Description of Molds 2 to 7)

As illustrated in FIGS. 1 to 7, the casting apparatus 1 includes six molds, that is, a first side mold 2, a second side mold 3, a lower mold 4 (which corresponds to a third mold according to the present disclosure), a front mold 5, a rear mold 6, and an upper mold 7 to form a cavity 9, which is a space portion corresponding to the shape of the cylinder block B. The sealed cavity 9 is formed by combining these six molds 2 to 7 at mold clamping. It should be noted that the front mold 5 and the upper mold 7 are illustrated simply in FIG. 1 by using dot-dot-dash lines to make the cavity 9 visible.

It should be noted that the first side mold 2 and the second side mold 3 are spaced apart from each other in a cylinder arrangement direction X of the cylinder block B so as to face each other. The lower mold 4 and the upper mold 7 are spaced apart from each other in a vertical direction Z so as to face each other. The front mold 5 and the rear mold 6 are spaced apart from each other in a width direction Y orthogonal to the cylinder arrangement direction X so as to face each other. The front mold 5 is disposed above a molten metal inlet 10, which will be described later.

The molten metal inlet 10 through which molten metal is input to the cavity 9 in a pressurized manner is formed in the lower mold 4. The molten metal inlet 10 is a through-hole that penetrates the lower mold 4 in the vertical direction Z. The molten metal inlet 10 communicates with the cavity 9 through the inflow gate 16. The inflow gate 16 is a passage formed by the facing surfaces of the lower mold 4 and the front mold 5 and extends diagonally upward.

Figure 6:
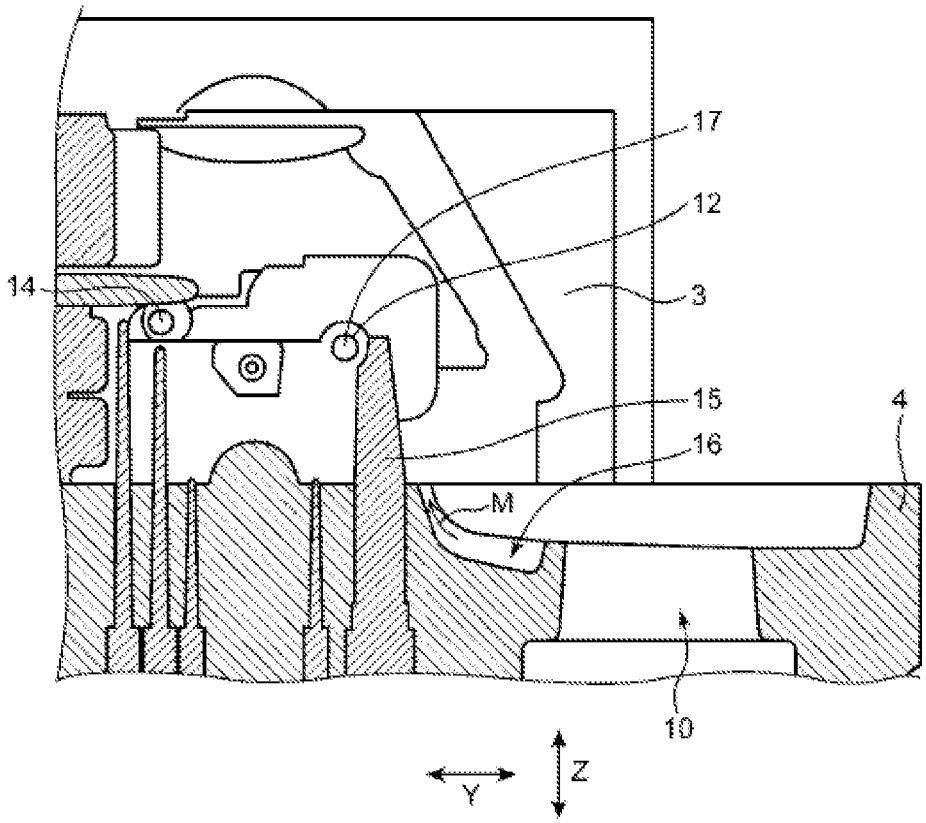
FIG. 6 is a vertical sectional view of the vicinity of a metal dowel in FIG. 1.
Figure 7:
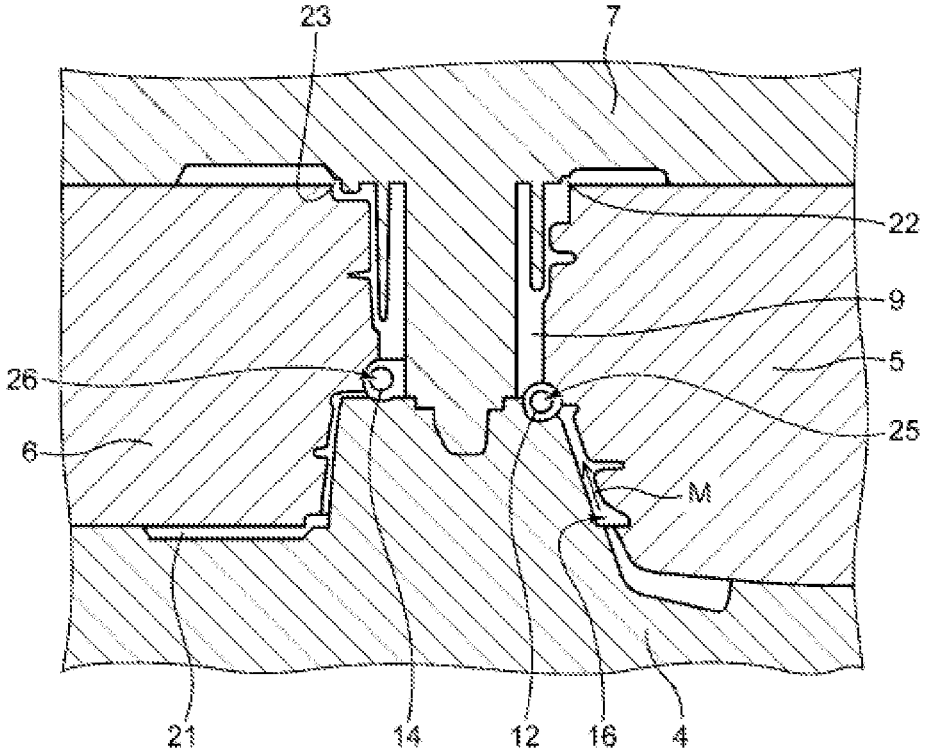
FIG. 7 is a vertical sectional view of the vicinity of a cavity and illustrates the state in which the molten metal flows into the cavity formed by the first to sixth molds of the casting apparatus in FIG. 1.

The molten metal formed by melting metal such as aluminum alloy is input to the cavity 9 in a pressurized manner from the molten metal inlet 10 through the inflow gate 16 under high temperature and high pressure as illustrated in FIGS. 6 and 7, whereby the cylinder block B with a shape corresponding to the shape of the cavity 9 is cast (specifically, die-cast molded). The residual portion of the molten metal having flowed into the cavity 9 and air are discharged to the outside of the cavity 9 through vents 21 to 23. The vents 21 to 23 are formed at positions away from the inflow gate 16, for example, a position between the lower mold 4 and the rear mold 6, a position between the front mold 5 and the upper mold 7, and a position between the rear mold 6 and the upper mold 7.

(Description of the Core Pins 11 to 14)

The casting apparatus 1 further includes four core pins (that is, a first core pin 11, a second core pin 12, a third core pin 13, and a fourth core pin 14) to form a first main gallery 25 and a second main gallery 26 (see FIGS. 7 and 12) in the cylinder block B as two lubricant passages.

It should be noted that the first main gallery 25 is the lubricant passage near the inflow gate 16 and supplies a lubricant to an oil jet (injection portion) that injects the lubricant to the back surface of the piston in the engine mainly in a high-speed operation or at high temperature. The second main gallery 26 (see FIGS. 7 and 12) is the lubricant passage farther from the inflow gate 16 and constantly supplies the lubricant to a crank journal in the engine and the oil jet described above while the engine is driven. The lubricant stored in a crankcase CC illustrated in FIG. 12 is supplied to the first main gallery 25 and the second main gallery 26 through the first supply passage 42 after being filtered by an oil filter 41. At the same time, the lubricant is also supplied to an oil gallery 44 for a valve opening/closing mechanism of the cylinder head CH through a second supply passage 43.

The first core pin 11 illustrated in FIGS. 1 to 5 is one portion of the core for forming the first main gallery 25 (see FIGS. 7 and 12) near the inflow gate 16 and is provided so as to project in the cylinder arrangement direction X in the cavity 9 on the surface of the first side mold 2 that faces the cavity 9.

The second core pin 12 illustrated in FIGS. 1 to 7 is the other portion of the core for forming the first main gallery 25 described above and is provided so as to project in the cylinder arrangement direction X in the cavity 9 on the surface of the second side mold 3 that faces the cavity 9. The second core pin 12 extends along an axial line (axial line extending in the cylinder arrangement direction X in this embodiment) that is the same as the axial line of the first core pin 11.

Figure 2:
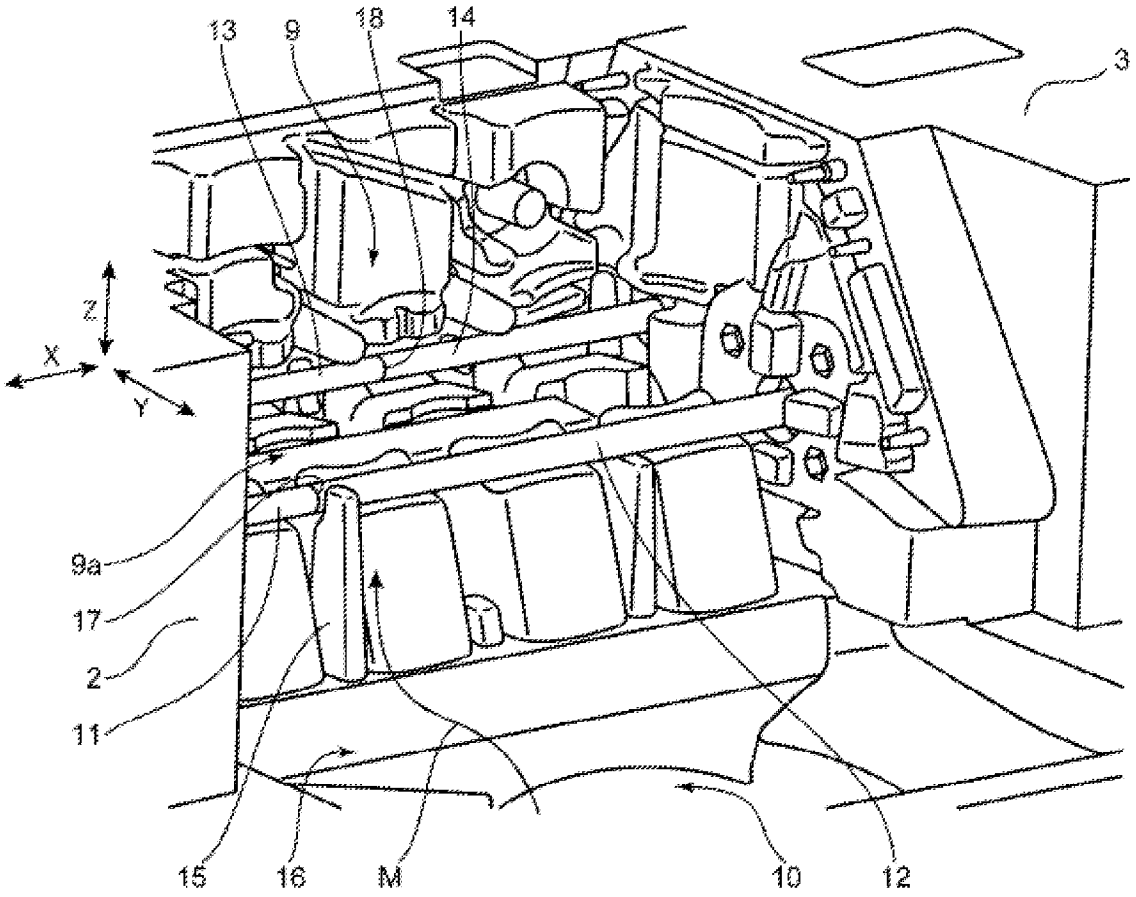
FIG. 2 is an enlarged perspective view illustrating the disposition of first to fourth core pins and a lower metal dowel in a cavity in FIG. 1.
Figure 3:
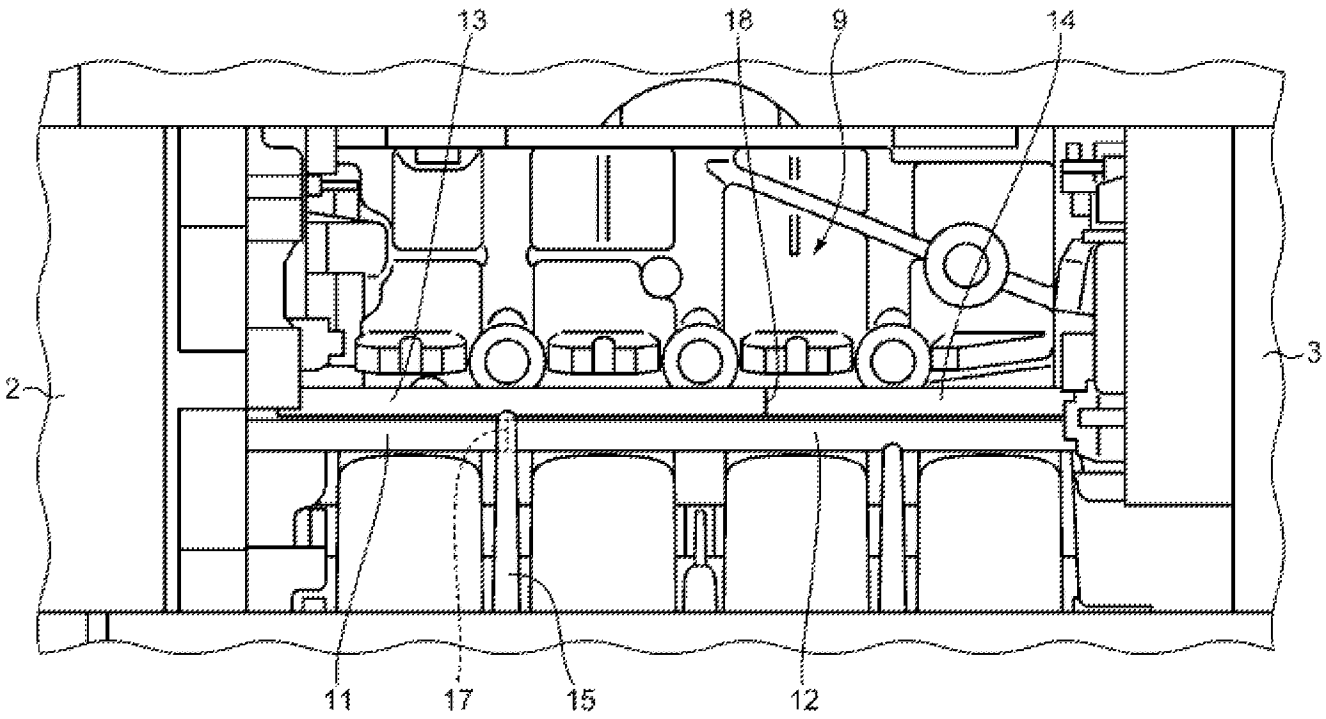
FIG. 3 is an enlarged plan view illustrating the disposition of the first to fourth core pins and the lower metal dowel in the cavity in FIG. 1.
Figure 5:
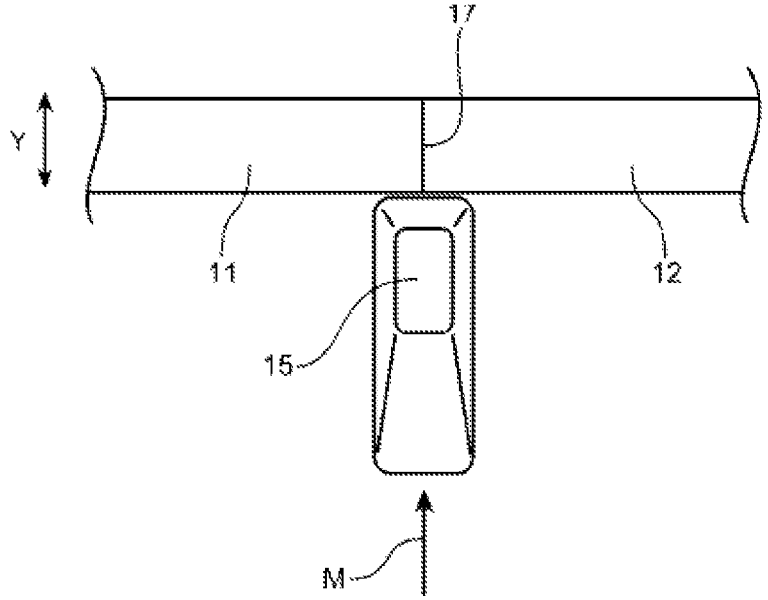
FIG. 5 is an explanatory diagram illustrating the state in which the butt portion between the first core pin and the second core pin in FIG. 4 is covered and shielded by the lower metal dowel from the upstream direction of molten metal.

The end portions of the first core pin 11 and the second core pin 12 are butted against each other (that is, the butt portion 17 in FIGS. 2, 3, and 5 is formed) at mold clamping, thereby constituting the core for forming the first main gallery 25, which is the passage in the cylinder block B through which the lubricant flows.

The third core pin 13 illustrated in FIGS. 1 to 5 is one portion of the core for forming the second main gallery 26 (see FIGS. 7 and 12) farther from the inflow gate 16 and is provided so as to project in the cylinder arrangement direction X in the cavity 9 on the surface of the first side mold 2 that faces the cavity 9.

The fourth core pin 14 illustrated in FIGS. 1 to 7 is the other portion of the core for forming the second main gallery 26 described above and is provided so as to project in the cylinder arrangement direction X in the cavity 9 on the surface of the second side mold 3 that faces the cavity 9. The fourth core pin 14 extends along an axial line (axial line extending in the cylinder arrangement direction X in this embodiment) that is the same as the axial line of the third core pin 13.

The end portions of the third core pin 13 and the fourth core pin 14 are butted against each other (that is, the butt portion 18 in FIGS. 2 and 3 is formed) at mold clamping, thereby constituting the core for forming the second main gallery 26, which is the passage in the cylinder block B through which the lubricant flows.

The third core pin 13 and the fourth core pin 14 are disposed on opposite sides of the first core pin 11 and the second core pin 12, respectively, with a cylinder forming region 9*a* of the cavity 9 in FIG. 2 sandwiched therebetween.

Figure 4:
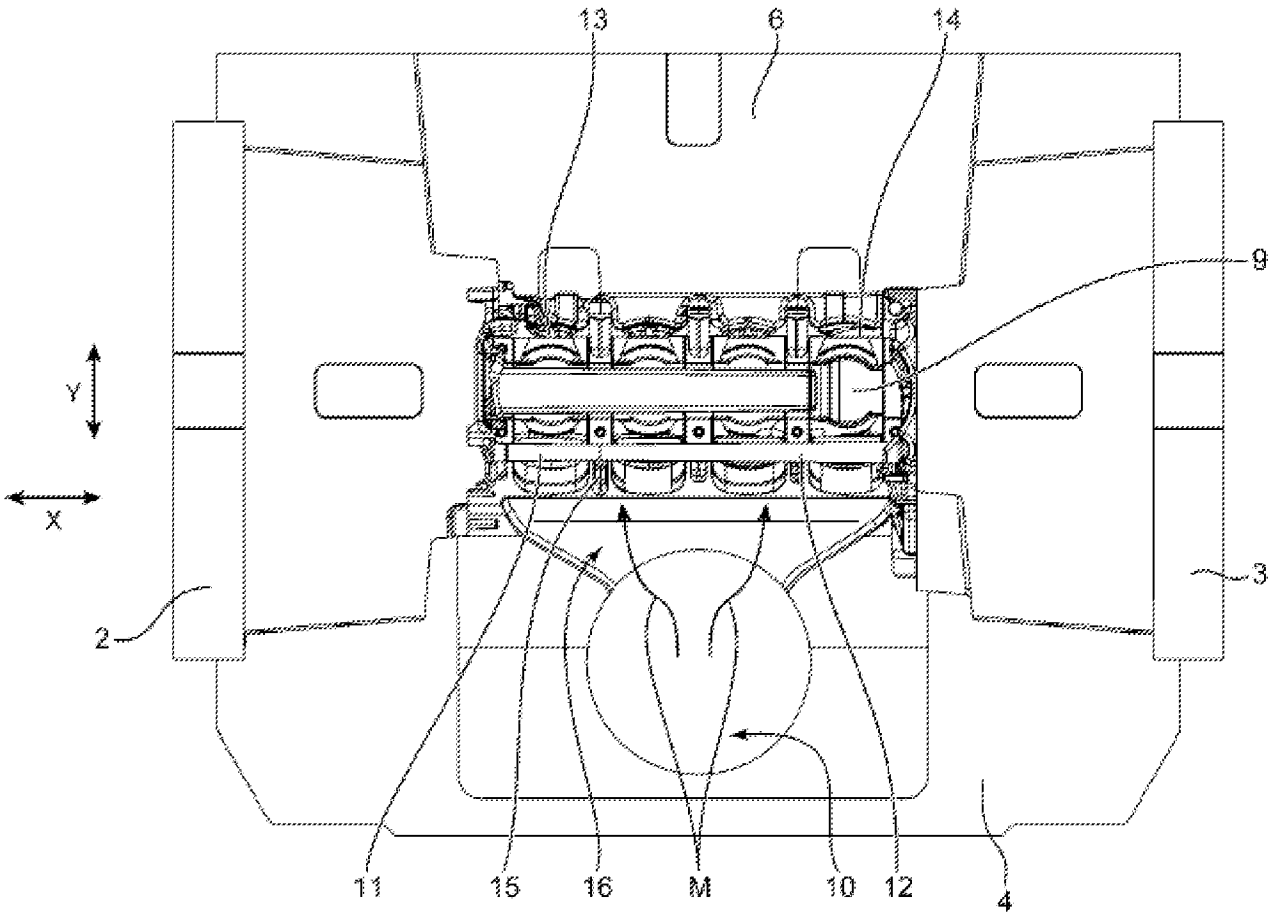
FIG. 4 is a plan view illustrating the planar disposition of first to third molds, a fifth mold, the first and second core pins, and the lower metal dowel of the casting apparatus in FIG. 1.

When the position of the molten metal inlet 10 described above is seen with respect to the first core pin 11 and the second core pin 12, as illustrated in FIGS. 1, 2, and FIG. 4, the molten metal inlet 10 is disposed so that the inflow direction M of the molten metal from the molten metal inlet 10 to the cavity 9 intersects (orthogonally intersects in FIGS. 1 to 2) the axial direction (the same direction as the cylinder arrangement direction X) of the first core pin 11 and the second core pin 12.

(Description of the Lower Metal Dowel 15)

As illustrated in FIGS. 1 to 6, in this embodiment, the lower metal dowel 15 is disposed in the cavity 9 to avoid a direct hit on the butt portion 17 between the first core pin 11 and the second core pin 12 by the molten metal flowing into the cavity 9 from the molten metal inlet 10.

At least a part of the lower metal dowel 15 only needs to be disposed in the cavity 9. In this embodiment, the lower metal dowel 15 is provided so as to penetrate the lower mold 4 in the vertical direction Z and the portion of the lower metal dowel 15 close to the upper end thereof projects to the inside of the cavity 9.

The lower metal dowel 15 is disposed at a position between the molten metal inlet 10 and the butt portion 17 between the first core pin 11 and the second core pin 12 at which the butt portion 17 is covered and shielded by the lower metal dowel 15 from the upstream side in the inflow direction M of the molten metal. Specifically, the inflow direction M in which the molten metal flows into the cavity 9 through the inflow gate 16 is orthogonal to the axial direction of the first core pin 11 and the second core pin 12 and oriented diagonally upward, as illustrated in FIG. 2 and FIGS. 4 to 6. Since the lower metal dowel 15 is disposed so as to extend in the vertical direction Z at a position on the upstream side in the inflow direction M of the molten metal in the butt portion 17, the lower metal dowel 15 can cover and shield the butt portion 17 from the molten metal flowing diagonally upward (see the inflow direction M).

In this embodiment, the lower metal dowel 15 is disposed so as to extend in a direction intersecting the axial direction (cylinder arrangement direction X) of the first core pin 11 and the second core pin 12. More specifically, in the structure in which the first core pin 11 and the second core pin 12 extend in the horizontal direction, the lower metal dowel 15 is disposed so as to extend in the vertical direction Z. Accordingly, it is possible to reliably avoid a direct hit on the butt portion 17 by the molten metal (see the inflow direction M) flowing diagonally upward along the inflow gate 16 by covering and shielding the butt portion 17 using the lower metal dowel 15 extending in the vertical direction Z.

In this embodiment, a core member for forming an oil return passage (cast passage for oil return) for returning the lubricant from the cylinder head CH of the engine 50 to the lower crankcase CC in FIG. 12 is formed in the cylinder block B is used as the lower metal dowel 15. It should be noted that the lower metal dowel 15 extends to approximately half the overall height of the cavity 9 that forms the cylinder block B and the passage portion above the lower metal dowel 15 is formed by boring a hole into the cast cylinder block in the vertical direction Z with a drill. This forms an oil return passage that penetrates the cylinder block B in the vertical direction Z from the cylinder head CH to the lower crankcase CC (see FIG. 12).

The lower metal dowel 15 illustrated in FIGS. 1 to 6 is shaped like an upward pointed thin plate, but the present disclosure is not limited to this shape and may have another shape such as a column (such as a cylinder or prism).

(Description of the Load Adjustment Portion 30)

Figure 8:
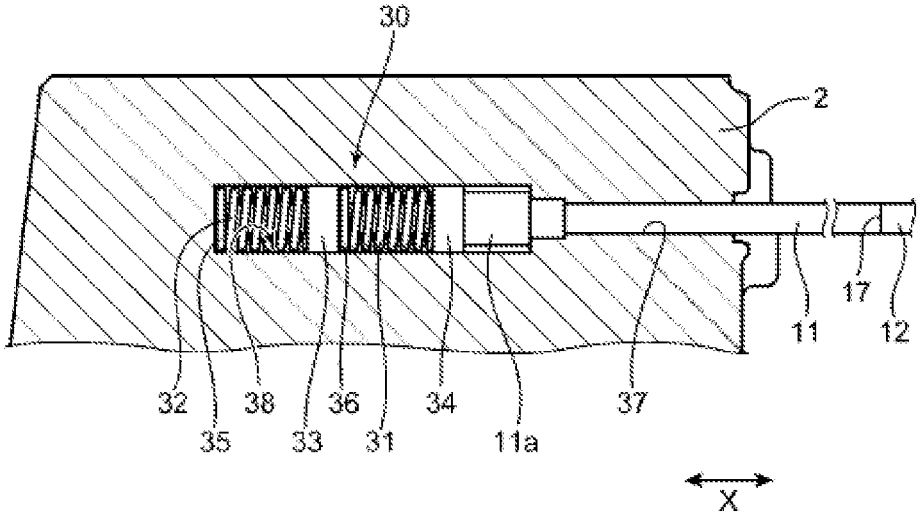
FIG. 8 is an explanatory view illustrating a cross section of a load adjustment portion included in the first mold in FIG. 1.

In this embodiment, the load adjustment portion 30 as illustrated in FIG. 8 is provided to adjust the loads acting on the first core pin 11 and the second core pin 12 when the first core pin 11 and the second core pin 12 are butted against each other and when the first core pin 11 and the second core pin 12 are subject to thermal expansion at casting.

The load adjustment portion 30 is provided at the base end portion of at least one of the first core pin 11 and the second core pin 12. In the example in FIG. 8, the load adjustment portion 30 is provided in the first side mold 2 so as to make contact with a base end portion 11*a* of the first core pin 11. Specifically, the first core pin 11 is inserted into an insertion hole 37 of the first side mold 2 that extends in the horizontal direction (specifically, the same direction as the cylinder arrangement direction X). In the first side mold 2, a space portion 38 that extends in the horizontal direction and communicates with the insertion hole 37 is formed. The space portion 38 houses the enlarged base end portion 11*a* of the first core pin 11 and the load adjustment portion 30. The base end portion 11*a* can move in the horizontal direction in the space portion 38 while receiving a load in the horizontal direction from the load adjustment portion 30.

The load adjustment portion 30 includes a first spring 31 and a second spring 32, disposed in series, that can be elastically deformed in the axial direction of the first core pin 11 and the second core pin 12, an intermediate member 33 sandwiched between the first spring 31 and the second spring 32, a front end member 34 sandwiched between the first spring 31 and the base end portion 11*a* of the first core pin 11, a rear end member 35 sandwiched between the second spring 32 and the back end of the space portion 38, and a restricting member 36 that distorts the first spring 31 in advance by a predetermined amount. The intermediate member 33, the front end member 34, and the restricting member 36 are disposed movably in the horizontal direction in the space portion 38.

The restricting member 36 is connected to the front end member 34 through the inside of the first spring 31 so as to be relatively movable in a horizontal direction within a predetermined stroke amount. The maximum spacing between the restricting member 36 and the front end member 34 is set shorter than the free length of the first spring 31. This distorts the first spring 31 by a predetermined amount in advance between the front end member 34 and the restricting member 36. Accordingly, the first spring 31 is distorted by a predetermined amount in advance before the first core pin 11 and the second core pin 12 are butted against each other, and the load on the first spring 31 differs from the load on the second spring 32 when these pins are butted against each other. In contrast, the second spring 32 is accommodated between the intermediate member 33 and the rear end member 35 so as to have a free length or to be distorted with a distortion amount smaller than the initial distortion amount of the first spring 31.

Figure 9:
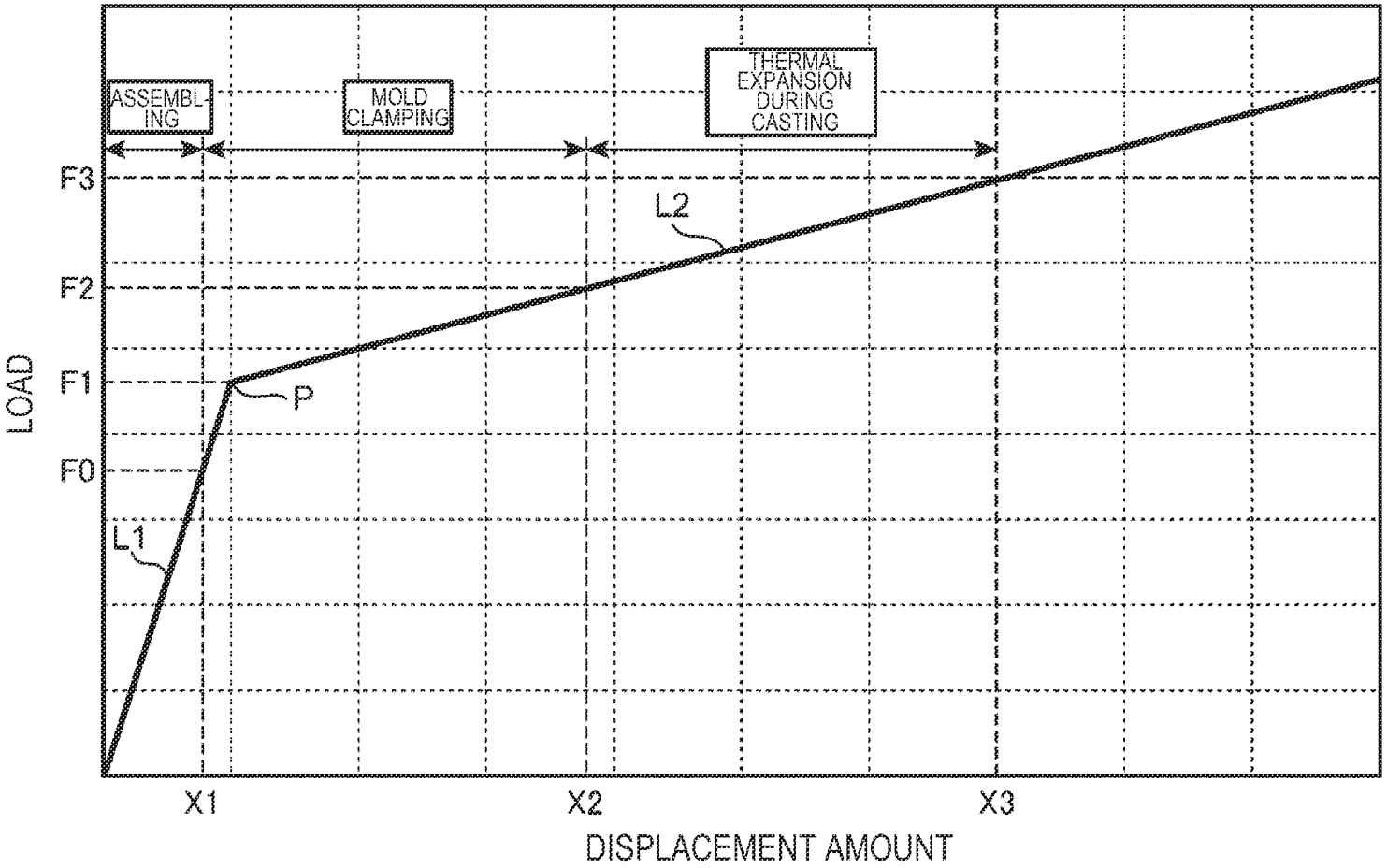
FIG. 9 is a graph illustrating the load characteristics of the load adjustment portion in FIG. 8.

FIG. 9 illustrates a graph illustrating the load characteristics of the load adjustment portion 30 with the structure described above. The horizontal axis of this graph represents the displacement amount of the entire load adjustment portion 30 and the vertical axis represents the load applied to the first core pin 11 by the load adjustment portion 30.

The "ASSEMBLING" process illustrated in FIG. 9 is the process of assembling the load adjustment portion 30 to the inside of the space portion 38 of the first side mold 2. In the assembling process, since the first spring 31 is distorted by a predetermined amount in advance and hardened between the front end member 34 and the restricting member 36 (that is, the first spring 31 is distorted by the distortion amount proportional to the load F1 in FIG. 9 as the initial load), the first spring 31 is not further compressed at this stage. In contrast, the second spring 32 is assembled between the intermediate member 33 and the rear end member 35 so as to be slightly distorted. At this time, only the second spring 32 is compressed and the characteristics of the spring constant due to only the second spring 32 are represented by the first load characteristic line L1 in FIG. 9. After the load adjustment portion 30 is assembled, the displacement amount (shrinkage amount) of the load adjustment portion 30 is X1 and the load acting on the first core pin 11 is F0.

Next, in the "MOLD CLAMPING" process in FIG. 9, the molds 2 to 7 described above are combined with each other to form the cavity 9 and the first core pin 11 and the second core pin 12 are butted against each other. At this time, in the initial state of the butt between the first core pin 11 and the second core pin 12, only the second spring 32 of the first spring 31 and the second spring 32 disposed in series is compressed. At this time, in the load characteristics illustrated in FIG. 9, when the load reaches the load F1 (that is, the load proportional to the predetermined distortion amount of the first spring 31), the first load characteristic line L1 bends at the change point P and a transition to a second load characteristic line L2, which has a gentler gradient than the first load characteristic line L1 (that is, both the first spring 31 and the second spring 32 are compressed). The second load characteristic line L2 represents the characteristics of the synthetic spring constant of the first spring 31 and the second spring 32.

From the butt between the first core pin 11 and the second core pin 12 to the completion of the mold clamping, the load adjustment portion 30 first increases the load on the first core pin 11 with a small displacement amount based on the spring constant of only the second spring 32 represented by the first load characteristic line L1. Then, when the load reaches the change point P at the load F1, a transition to the second load characteristic line L2 is made and the load adjustment portion 30 adjusts the load on the first core pin 11 so as to reach the target mold clamping load F2 at the displacement amount X2 with a large displacement amount based on the synthetic spring constant (spring constant lower than the spring constant of only the second spring 32) of the first spring 31 and the second spring 32.

Furthermore, in the "THERMAL EXPANSION AT TIME OF CASTING" process in FIG. 9, the second load characteristic line L2 represents the load characteristics in which a buckling limit load F3 is not exceeded with respect to the displacement amount of the load adjustment portion 30 even if the base end portion 11*a* of the first core pin 11 is retracted toward the back (the left end in FIG. 8) of the space portion 38 due to the thermal expansion of the first core pin 11 and the second core pin 12 at the time of casting. That is, the gradient of the second load characteristic line L2 is determined based on the maximum displacement amount X3 of the load adjustment portion 30 due to the thermal expansion of the first core pin 11 and the buckling limit load F3.

(Characteristics of this Embodiment)

(1)

The casting apparatus 1 according to this embodiment casts the cylinder block B of the engine 50 and includes the first side mold 2 having the first core pin 11, the second side mold 3, disposed facing the first side mold 2, that has the second core pin 12 extending along the axial line as in the first core pin 11, the lower mold 4 (corresponding to the third mold according to the present disclosure) that forms the cavity 9 together with the first side mold 2 and the second side mold 3 at mold clamping and has the molten metal inlet 10 through which the molten metal is injected to the cavity 9, and the lower metal dowel 15, at least a part of which is disposed in the cavity 9, that is provided in the lower mold 4. The molten metal inlet 10 is disposed so that the inflow direction M of the molten metal from the molten metal inlet 10 to the cavity 9 intersects the axial direction (cylinder arrangement direction X) of the first core pin 11 and the second core pin 12. The first core pin 11 and the second core pin 12 form a core that forms the first main gallery 25, which is a passage of the cylinder block B through which the lubricant flows by butting the end portions of the first core pin 11 and the second core pin 12 against each other at mold clamping. The lower metal dowel 15 is disposed at a position between the molten metal inlet 10 and the butt portion 17 between the first core pin 11 and the second core pin 12 at which the butt portion 17 is covered and shielded by the lower metal dowel 15 from the upstream side in the inflow direction M of the molten metal.

In the structure described above, when the cylinder block B having the first main gallery 25 in the side portion of the cylinder block B near the molten metal inlet 10 is cast, the first side mold 2, the second side mold 3, and the lower mold 4 are combined to form the cavity 9 at mold clamping and the first core pin 11 and the second core pin 12 are butted against each other to form the first main gallery 25 in the cavity 9. In the cavity 9, the lower metal dowel 15 is disposed at a position between the molten metal inlet 10 and the butt portion 17 between the first core pin 11 and the second core pin 12 at which the butt portion 17 can be covered and shielded by the lower metal dowel 15 from the upstream side in the inflow direction M of the molten metal. Since the butt portion 17 is covered and shielded by the lower metal dowel 15 from the upstream side in the inflow direction M of the molten metal in this state, a direct hit on the butt portion 17 by the molten metal can be avoided when the molten metal flows into the cavity 9 from the molten metal inlet 10. Accordingly, the butt portion 17, which is the bending starting point of the first and second core pins 11 and 12, is protected from a direct hit by the molten metal, whereby the deformation of the first and second core pins 11 and 12 can be suppressed and the deformation of the first main gallery 25, which is the cast passage formed by the first and second core pins 11 and 12, can also be suppressed. Furthermore, the occurrence of burrs in the butt portion 17 can be prevented by keeping these pins butted against each other. As a result, machining with a drill or the like is not necessary to form the first main gallery 25.

(2)

In the casting apparatus 1 according to this embodiment, the lower metal dowel 15 is disposed so as to extend in a direction intersecting the axial direction (cylinder arrangement direction X) of the first core pin 11 and the second core pin 12.

In the structure described above, the lower metal dowel 15 that forms the cast passage extends in the direction that intersects the axial direction (cylinder arrangement direction X) of the first core pin 11 and the second core pin 12 and is disposed closer to the molten metal inlet 10 than the first core pin 11 and the second core pin 12 so that the butt portion 17 between the first core pin 11 and the second core pin 12 is extensively covered by the lower metal dowel 15 extending in the intersecting direction. This can reliably avoid a direct hit on the butt portion 17 by the molten metal.

(3)

In the casting apparatus 1 according to this embodiment, the first core pin 11 and the second core pin 12 are disposed so as to extend in the horizontal direction and the lower metal dowel 15 is disposed so as to extend in the vertical direction Z.

In the structure described above, the lower metal dowel 15 forms the cast passage extending in the vertical direction Z.

The lower metal dowel 15 orthogonally intersects the first core pin 11 and the second core pin 12 extending in the horizontal direction and is disposed closer to the molten metal inlet 10 than the first core pin 11 and the second core pin 12 so as to extensively cover the butt portion 17 between the first core pin 11 and the second core pin 12 with the lower metal dowel 15 extending in the vertical direction Z. This can more reliably avoid a direct hit on the butt portion 17 by the molten metal.

(4)

In the casting apparatus 1 according to this embodiment, the lower metal dowel 15 is the core member that forms, in the cylinder block B, an oil return passage through which the lubricant is returned from the cylinder head CH to the crankcase CC.

In the structure described above, by using the core member that forms, in the cylinder block B, an oil return passage through which the lubricant is returned from the cylinder head CH to the crankcase CC as the lower metal dowel 15 described above, it is possible to avoid a direct hit on the butt portion 17 between the first core pin 11 and the second core pin 12 by the molten metal by covering the butt portion 17. Accordingly, it is not necessary to provide a dedicated lower metal dowel 15 for avoiding a direct hit on of the butt portion 17 by the molten metal separately from the core member for the oil return passage, thereby avoiding an increase in the number of components of the casting apparatus 1.

(5)

In the casting apparatus 1 according to this embodiment, the first spring 31 and the second spring 32 that are elastically deformable in the axial direction of the first core pin 11 and the second core pin 12 are disposed in series in the base end portion of at least one of the first core pin 11 and the second core pin 12. The first spring 31 is distorted by a predetermined amount in advance before the first core pin 11 and the second core pin 12 are butted against each other, and the load on the first spring 31 differs from the load on the second spring 32 when these springs are butted against each other.

In the structure described above, when the first core pin 11 and the second core pin 12 are butted against each other, only the second spring 32 of the first spring 31 and the second spring 32 disposed in series is compressed and the first core pin 11 and the second core pin 12 can be butted against each other with a large spring constant, a short stroke, and an appropriate load. In contrast, when the cylinder block B is formed by casting, the change in the load with respect to the stroke amount can be reduced with a low spring constant by simultaneously compressing the first spring and second spring about the elongation due to thermal expansion of the first and second core pins by compressing. As a result, the bending of the first and second core pins 11 and 12 can be prevented.

(Modifications)

(A)

In the embodiment described above, the lower metal dowel 15 provided in the lower mold 4 is adopted as an example of the metal dowel for avoiding a direct hit on the butt portion 17 between the first core pin 11 and the second core pin 12 by the molten metal, but the present disclosure is not limited to this embodiment. At least a part of the metal dowel according to the present disclosure only needs to be disposed at a position in the cavity 9, between the molten metal inlet 10 and the butt portion 17 between the first core pin 11 and the second core pin 12, at which the butt portion 17 can be covered and shielded by the metal dowel from the upstream side in the inflow direction M.

Figure 10:
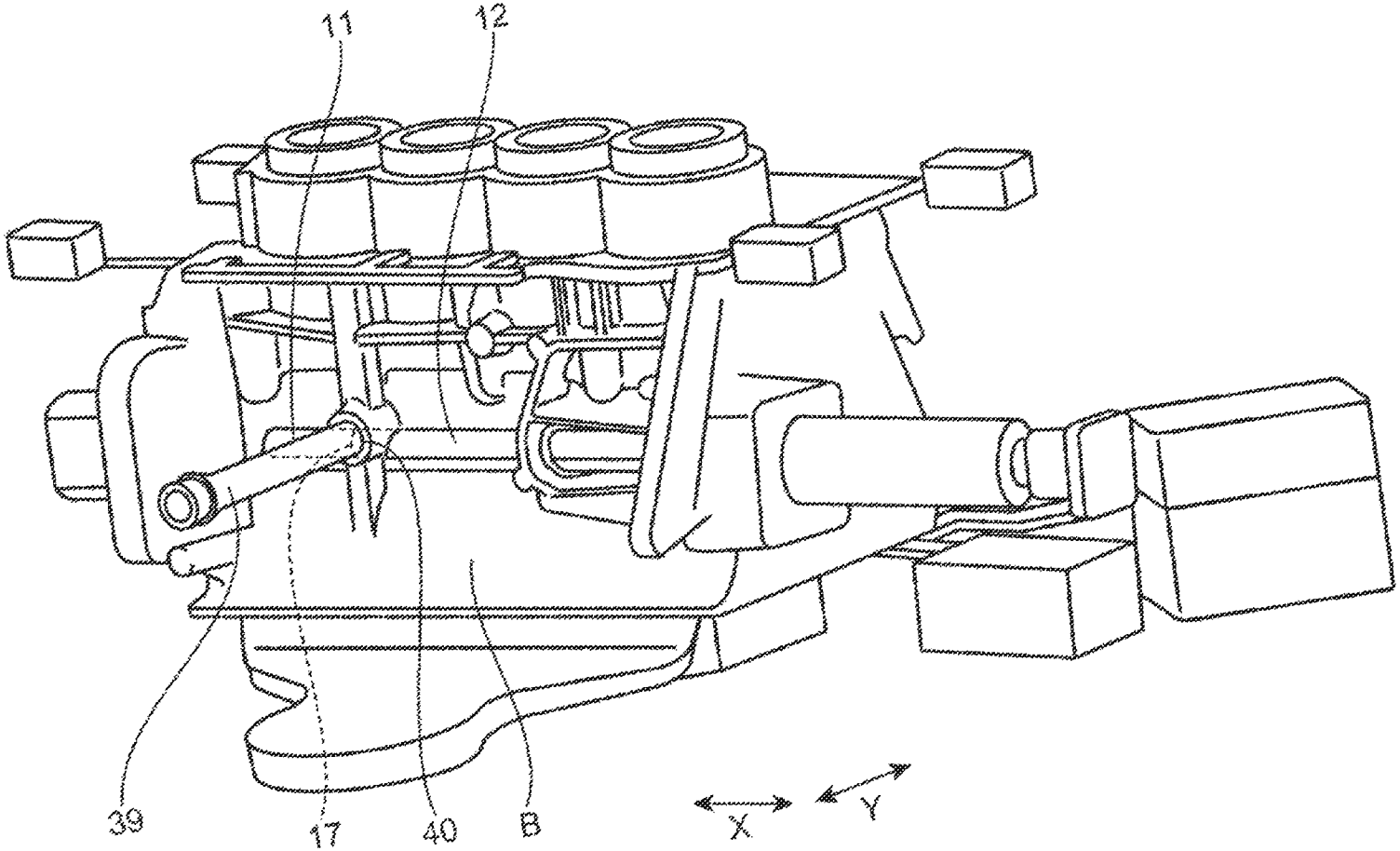
FIG. 10 is a perspective explanatory view illustrating the casting of a cylinder block using a casting apparatus to which a front metal dowel has been added according to another embodiment of the present disclosure.
Figure 11:
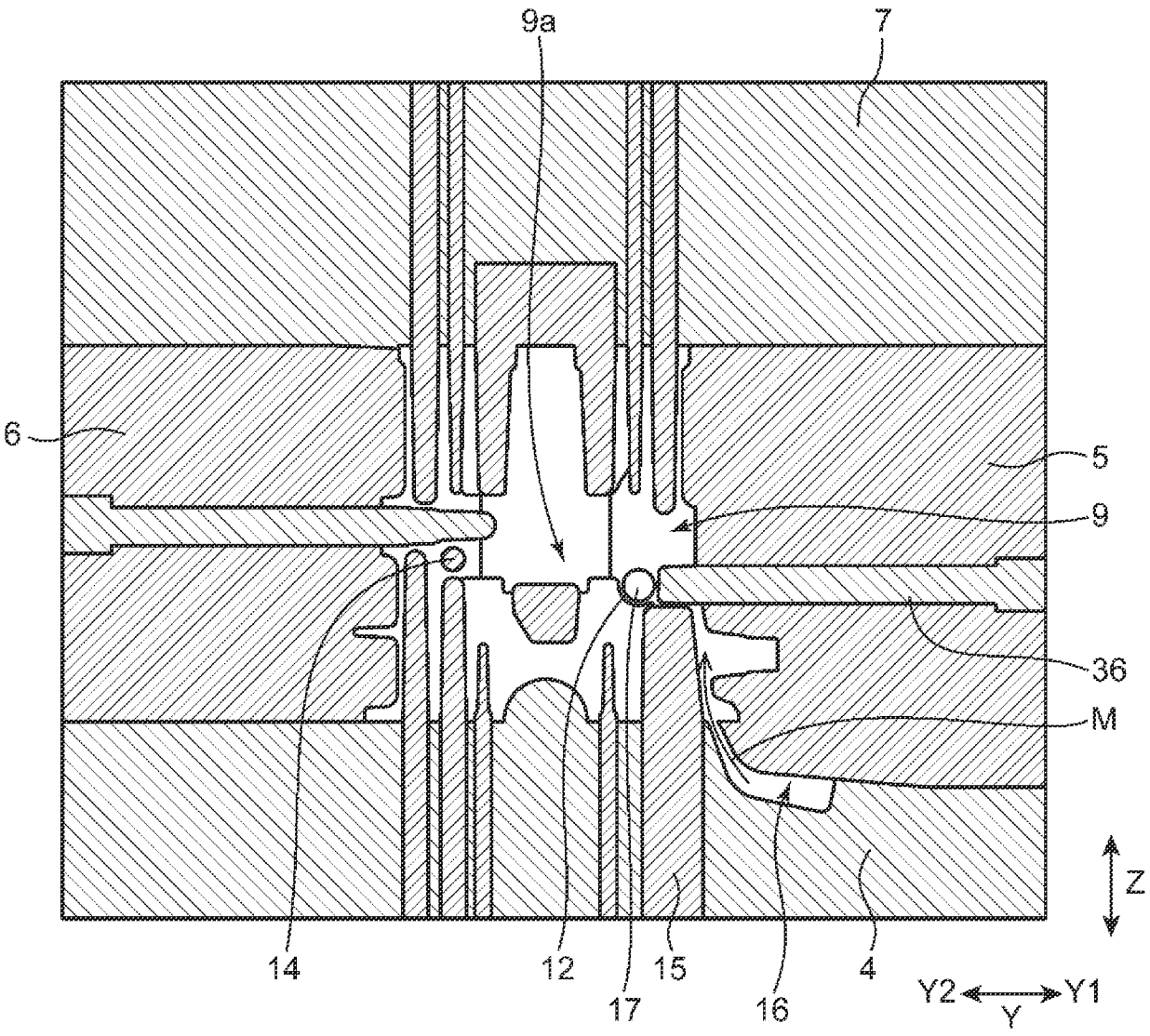
FIG. 11 is a vertical sectional view of the vicinity of the cavity of the casting apparatus to which the front metal dowel in FIG. 10 has been added.

Accordingly, in a casting apparatus according to a modification of the present disclosure, the metal dowel may be the front metal dowel 39 illustrated in FIGS. 10 and 11.

FIG. 10 is a perspective explanatory view illustrating the casing of the cylinder block B using the casting apparatus to which the front metal dowel 39 has been added as another embodiment of the present disclosure. FIG. 11 is a vertical sectional view of the vicinity of the cavity 9 of the casting apparatus to which the front metal dowel 39 in FIG. 10 has been added.

As illustrated in FIGS. 10 and 11, the front metal dowel 39 is disposed so as to extend in the horizontal direction from the upstream side in the inflow direction M of the molten metal so as to intersect the axial direction (cylinder arrangement direction X) of the first core pin 11 and the second core pin 12, specifically so as to extend in the width direction Y of the cylinder block B orthogonal to the axial direction (cylinder arrangement direction X).

The front metal dowel 39 is provided so as to penetrate the front mold 5 in the front-rear direction (width direction Y described above) and the portion near the end of the front metal dowel 39 projects to the inside of the cavity 9.

The end of the front metal dowel 39 is disposed at a position at which the butt portion 17 between the first core pin 11 and the second core pin 12 is covered and shielded by the end from the upstream side (that is, from the front side Y1 in the width direction Y) in the inflow direction M of the molten metal.

The front metal dowel 39 is a core member that forms a cast hole 40 for thinning or attachment of an auxiliary that extends in the horizontal direction (specifically, the width direction Y of the cylinder block B).

The modified casting apparatus according to the modification illustrated in FIGS. 10 and 11 has the same structure as the casting apparatus 1 (see FIGS. 1 to 8) according to the embodiment described above with the exception of the structure described above. That is, the casting apparatus according to the modification illustrated in FIG. 11 has two metal dowels as the metal dowels according to the present disclosure, that is, not only the front metal dowel 39 but also the lower metal dowel 15 of the embodiment described above. In this structure, since the butt portion 17 can be covered and shielded by both the lower metal dowel 15 and the front metal dowel 39 from the molten metal flowing diagonally upward along the inflow gate 16 (see the inflow direction M), a direct hit on the butt portion 17 by the molten metal can be more reliably avoided.

As described above, in the casting apparatus according to the modification illustrated in the FIGS. 10 and 11 above, the front metal dowel 39 extends in the horizontal direction from the upstream side in the inflow direction M of the molten metal so as to intersect the axial direction (cylinder arrangement direction X) of the first core pin 11 and the second core pin 12. The end of the lower metal dowel 15 is disposed at a position at which the butt portion 17 can be covered and shielded by the end from the upstream side in the inflow direction M of the molten metal.

In the structure described above, the front metal dowel 39 extends in the horizontal direction (width direction Y) from the upstream side in the inflow direction M of the molten metal so as to intersect the axial direction (cylinder arrangement direction X) of the first core pin 11 and the second core pin 12, and the end of the front metal dowel 39 is disposed on the upstream side in the inflow direction M of the molten metal of the butt portion 17. In this structure, the molten metal toward the butt portion 17 flows in the horizontal direction along the front metal dowel 39, thereby weakening the momentum of the molten metal toward the butt portion 17 due to the flow resistance around the front metal dowel 39. Furthermore, since the butt portion 17 is covered and shielded by the end of the lower metal dowel 15 from the upstream side in the inflow direction M of the molten metal, a direct hit on the butt portion 17 by the molten metal can be avoided.

Furthermore, in the casting apparatus according to the modification described above, the front metal dowel 39 is the core member that forms a cast hole 40, for thinning or attachment of an auxiliary that extends in the horizontal direction.

In the structure described above, it is possible to avoid a direct hit on the butt portion 17 by the molten metal by covering the butt portion 17 between the first core pin 11 and the second core pin 12 using, as the front metal dowel 39 described above, the core member that forms the cast hole 40, for thinning or attachment of auxiliary, that extends in the horizontal direction. Accordingly, a dedicated front metal dowel 39 for avoiding a direct hit on the butt portion 17 by the molten metal does not need to be provided separately from the core member for the above purpose, thereby avoiding an increase in the number of components of the casting apparatus 1.

(B)

It should be noted that the metal dowel according to the present disclosure is not limited to the lower metal dowel 15 provided in the lower mold 4 illustrated in the embodiment described above or the front metal dowel provided in the front mold 5 illustrated in the modification, and may be the upper metal dowel provided in the upper mold 7 or the rear metal dowel provided in the rear mold 6 as long as the metal dowel can be disposed between the molten metal inlet 10 and the butt portion 17.

(C)

The lower mold 4 corresponds to the third mold according to the present disclosure and the molten metal inlet 10 is formed in the lower mold 4 in the embodiment described above, but the present disclosure is not limited to this embodiment and the molten metal inlet 10 can be formed in a mold other than the first side mold 2 and the second side mold 3. Accordingly, the molten metal inlet 10 can be formed in any of the front mold 5, the rear mold 6, and the upper mold 7 (that is, the front mold 5, the rear mold 6, or the upper mold 7 can also be the third mold according to the present disclosure).

In this case as well, as long as the metal dowel is disposed on the upstream side of the butt portion 17 between the first core pin 11 and the second core pin 12 in the inflow direction M of the molten metal, a direct hit on the butt portion 17 by the molten metal can be avoided.

What is claimed is:

1. A casting apparatus for casting a cylinder block of an engine, comprising:

a first side mold having a first core pin;

a second side mold disposed facing the first side mold, the second side mold having a second core pin extending along an axial line that is the same as an axial line of the first core pin;

a third mold that forms a cavity together with the first side mold and the second side mold at mold clamping, the third mold having a molten metal inlet through which molten metal is injected into the cavity; and a metal dowel at least a part of which is disposed in the cavity, wherein the molten metal inlet is disposed so that an inflow direction of the molten metal from the molten metal inlet to the cavity intersects with an axial direction of the first core pin and the second core pin, the first core pin and the second core pin form a core for forming a main gallery that is a passage in the cylinder block through which a lubricant flows, by butting end portions of the first core pin and the second core pin against each other at mold clamping, and the metal dowel is disposed at a position between the molten metal inlet and a butt portion between the first core pin and the second core pin, at which the butt portion is covered and shielded by the metal dowel from an upstream side in the inflow direction of the molten metal.

2. The casting apparatus according to claim 1, wherein the metal dowel is disposed so as to intersect the axial direction of the first core pin and the second core pin.

3. The casting apparatus according to claim 2, wherein the first core pin and the second core pin are disposed so as to extend in a horizontal direction, and the metal dowel is disposed so as to extend in a vertical direction.

4. The casting apparatus according to claim 3, wherein the metal dowel is a core member that forms, in the cylinder block, an oil return passage through which the lubricant is returned from a cylinder head to a crankcase.

5. The casting apparatus according to claim 4, wherein a first spring and a second spring are disposed in series in a base end portion of at least one of the first core pin and the second core pin, the first spring and the second spring being elastically deformable in the axial direction of the first core pin and the second core pin, and the first spring is distorted by a predetermined amount in advance before the first core pin and the second core pin are butted against each other, and a load on the first spring differs from a load on the second spring when the first core pin and the second core pin are butted against each other.

6. The casting apparatus according to claim 3, wherein a first spring and a second spring are disposed in series in a base end portion of at least one of the first core pin and the second core pin, the first spring and the second spring being elastically deformable in the axial direction of the first core pin and the second core pin, and the first spring is distorted by a predetermined amount in advance before the first core pin and the second core pin are butted against each other, and a load on the first spring differs from a load on the second spring when the first core pin and the second core pin are butted against each other.

7. The casting apparatus according to claim 2, wherein a first spring and a second spring are disposed in series in a base end portion of at least one of the first core pin and the second core pin, the first spring and the second spring being elastically deformable in the axial direction of the first core pin and the second core pin, and the first spring is distorted by a predetermined amount in advance before the first core pin and the second core pin are butted against each other, and a load on the first spring differs from a load on the second spring when the first core pin and the second core pin are butted against each other.

8. The casting apparatus according to claim 1, wherein the metal dowel is disposed so as to extend in the horizontal direction from an upstream side in the inflow direction of the molten metal so as to intersect the axial direction of the first core pin and the second core pin, and an end of the metal dowel is disposed at a position at which the butt portion is covered and shielded by the end from the upstream side in the inflow direction of the molten metal.

9. The casting apparatus according to claim 8, wherein the metal dowel is a core member that forms a cast hole for thinning or attachment of an auxiliary that extends in the horizontal direction.

10. The casting apparatus according to claim 9, wherein a first spring and a second spring are disposed in series in a base end portion of at least one of the first core pin and the second core pin, the first spring and the second spring being elastically deformable in the axial direction of the first core pin and the second core pin, and the first spring is distorted by a predetermined amount in advance before the first core pin and the second core pin are butted against each other, and a load on the first spring differs from a load on the second spring when the first core pin and the second core pin are butted against each other.

11. The casting apparatus according to claim 8, wherein a first spring and a second spring are disposed in series in a base end portion of at least one of the first core pin and the second core pin, the first spring and the second spring being elastically deformable in the axial direction of the first core pin and the second core pin, and the first spring is distorted by a predetermined amount in advance before the first core pin and the second core pin are butted against each other, and a load on the first spring differs from a load on the second spring when the first core pin and the second core pin are butted against each other.

12. The casting apparatus according to claim 1, wherein a first spring and a second spring are disposed in series in a base end portion of at least one of the first core pin and the second core pin, the first spring and the second spring being elastically deformable in the axial direction of the first core pin and the second core pin, and the first spring is distorted by a predetermined amount in advance before the first core pin and the second core pin are butted against each other, and a load on the first spring differs from a load on the second spring when the first core pin and the second core pin are butted against each other.

13. The casting apparatus according to claim 1, wherein the inflow direction in which the molten metal flows into the cavity is orthogonal to the axial direction of the first core pin and the second core pin and oriented diagonally upward, and the metal dowel is disposed so as to extend in a vertical direction at a position on the upstream side in the inflow direction of the molten metal in the butt portion such that the metal dowel covers and shields the butt portion from the molten metal flowing diagonally upward.

* * * * *